United States Patent [19]

Fujihashi

[11] 4,456,023

[45] Jun. 26, 1984

[54] COLLAPSIBLE UMBRELLA WITH WATER-TIGHT SHEATHING HANDLE

[76] Inventor: Norikazu Fujihashi, 1-27, Kumoicho, Nishinomiya, Hyogo, 662, Japan

[21] Appl. No.: 398,222

[22] Filed: Jul. 14, 1982

[30] Foreign Application Priority Data

Jul. 25, 1981 [JP] Japan ..... 56-110734[U]

[51] Int. Cl.[3] ..... A45B 19/00

[52] U.S. Cl. ..... 135/25 R

[58] Field of Search ..... 135/25 R, 25 A, 33 R, 135/33 C, 36 RT, 36 TP

[56] References Cited

U.S. PATENT DOCUMENTS

| | | | |
|---|---|---|---|
| 868,326 | 10/1907 | Casale | 135/25 R X |
| 892,813 | 7/1908 | Dolles | 135/25 R |
| 1,885,968 | 11/1932 | Wedemann | 135/25 R X |
| 1,911,784 | 5/1933 | Adler | 135/25 R |
| 2,091,676 | 8/1937 | Fliegner | 135/25 R |
| 3,730,199 | 5/1973 | Thur | 135/20 R |
| 3,744,502 | 7/1973 | Weber | 135/20 R |
| 4,080,976 | 3/1978 | Hirai | 135/25 R |
| 4,105,039 | 8/1978 | Schultes et al. | 135/25 A |

*Primary Examiner*—Harland S. Skogquist

*Attorney, Agent, or Firm*—Sandler & Greenblum

[57] ABSTRACT

A collapsible umbrella with a rigid tubular sheathing handle being attached to a central telescopic stick in such a way that the umbrella in a fully collapsed condition may be withdrawn in the sheathing handle in a completely water-tight manner when a sliding member fixed to the lower end of the stick is at the bottom of the tubular sheathing handle, and that the umbrella in a fully collapsed condition may be taken out of the sheathing handle to be opened for use when the sliding member is retained near the top end of the sheathing handle, thereby rendering the sheathing handle serviceable dually as a storing sheath when the umbrella is not in use and as a handle when it is in use.

2 Claims, 5 Drawing Figures

COLLAPSIBLE UMBRELLA WITH WATER-TIGHT SHEATHING HANDLE

BACKGROUND OF THE INVENTION

1. Field of the Invention

The present invention relates to an umbrella, and more particularly to a collapsible umbrella of the kind having a rigid tubular sheath member to store the umbrella in a fully collapsed condition therein.

2. Description of the Prior Art

This kind of collapsible umbrella is usually provided with a central telescopic stick, a radiating folding frame or rib assembly partially slidable on the central stick, and a circular fabric canopy or top cover fastened to the radiating frame. The stick is retracted and extended telescopically, the frame is folded and unfolded together with the canopy, and the umbrella as a whole is stretched and collapsed in two or three stages, for example, as disclosed in U.S. Pat. Nos. 4,080,976 and 4,105,039. In a fully collapsed condition the umbrella is stored within a rigid tubular sheath member the length of which is approximately equal to that of the fully collapsed umbrella, for example, as disclosed in U.S. Pat. Nos. 3,730,199 and 3,744,502.

Conventionally in the above-described kind of umbrella, the sheath member is usually detached from the umbrella when the latter is stretched or opened on use. Then the detached sheath member must be kept in a bag or some other suitable container if available . Alternatively, one must open and hold the umbrella while he is keeping the detached sheath member in one hand. Moreover, the sheath member is not completely water-tight. Thus the umbrella, collapsed and stored within the sheath member immediately after use, will often cause moisture trouble to persons or things in touch with it. This is a great problem, because a main advantage of a collapsible umbrella is that, immediately after use, it can be collapsed compactly and carried together with other things within or without a bag or some other container. Often this takes place in a crowded location. In addition, the combination of a collapsible umbrella with a rigid sheath member is often not handy.

SUMMARY OF THE INVENTION

It is, therefore, an object of the present invention to provide a collapsible umbrella with a completely water-tight sheath member so as to eliminate the possibility of causing moisture trouble while the umbrella is stored in the sheath member.

Another object of the invention is to provide a collapsible umbrella having a sheathing handle attached to the central telescopic stick so that it may serve dually as a handle to hold the umbrella therewith when it is in use, and as a sheath to store the umbrella therein when it is not in use.

A further object of the invention is to provide a very handy collapsible umbrella with a rigid tubular sheath member.

A collapsible umbrella in accordance with the invention is provided with a central telescopic stick and a rigid tubular sheathing handle attached to the central stick. The central stick is provided with a rotatable cap member at the upper end thereof and a sliding member fixed at the lower end thereof. The sliding member is slidably engaged with the tubular sheathing handle. The tubular sheathing handle has an open top end and a closed bottom end. The sliding member is insertably positioned and movable within the tubular sheathing handle.

When the sliding member is at the closed bottom end of the sheathing handle, the umbrella stick, frame and canopy in a fully collapsed condition are withdrawn altogether into the sheathing handle. Then the cap member is screwed to the open top end of the sheathing handle in cooperation with a packing member to close it water-tightly, and the sheathing handle serves as a storing sheath for the umbrella.

When the cap member is unscrewed from the top end of the sheathing handle and the sliding member is retained near the top end thereof, the umbrella stick, frame and canopy altogether are taken out of the sheathing handle from their fully collapsed condition. They are then stretched or opened in a known way, and the sheathing handle serves as a handle for the umbrella.

BRIEF DESCRIPTION OF THE DRAWINGS

Other objects and advantages of the invention will be readily appreciated as they become better understood hereinafter when considered in connection with the accompanying drawings in which.

DESCRIPTION OF PREFERRED EMBODIMENTS

The embodiment shown in FIGS. 1, 2, 3 and 5 comprises a central telescopic stick 2, a radiating folding frame 2' partially slidable on the central stick 2, a circular fabric canopy 7 fastened to the radiating frame 2', and a rigid tubular sheathing handle 1 attached to the central stick 2 in an aligned relation thereto.

The relative arrangement of umbrella stick 2, frame 2' and canopy 7 is such that they may be stretched and collapsed in three stages in a known manner.

Figure 1:
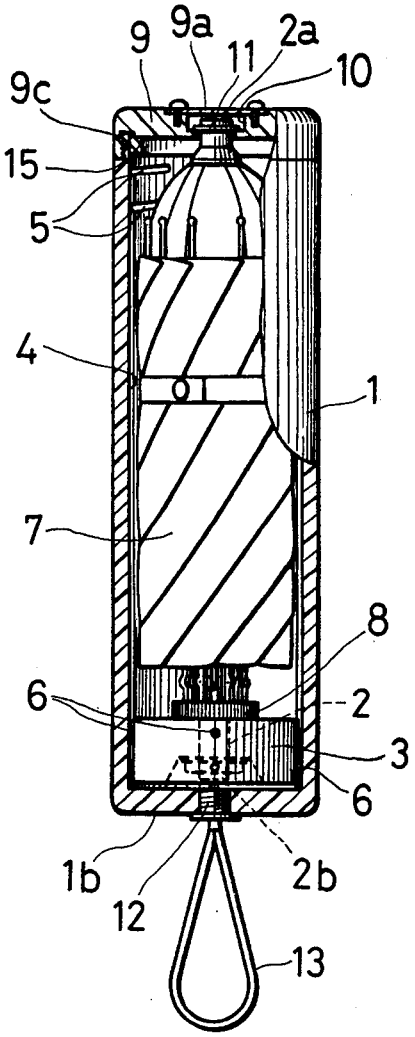
FIG. 1 is a partially sectional elevation of a collapsible umbrella with a sheathing handle embodying the invention, when the umbrella stick, frame and canopy are stored altogether in a fully collapsed condition in the sheathing handle.

As shown in FIG. 1, the central telescopic stick 2 has an upper end **2*a* which is provided with a round cap member 9 in a rotatable relation thereto, and also has a lower end 2*b* which is provided with a cylindrical sliding member 3** in a fixed relation thereto.

The round cap member 9 has a central aperture 10 in which the upper end **2*a* of central stick 2 is retained in a rotatably engaging relation to the cap member 9 by means of a snap ring 11 provided around it as best shown in FIG. 1. A cover member 9*a* is provided to close the aperture 10 water-tightly by means of screws in cooperation with suitable packing members (not shown ). The cap member 9 has a lower end which is provided with a threaded inner wall 9*c* as shown in FIG. 1**.

The cylindrical sliding member 3 has an outer wall which is provided with a plurality of tongue members 6 projecting radiately therefrom. The sliding member 3 is fixed to the lower end 2b of central stick 2 securely.

Figure 2:
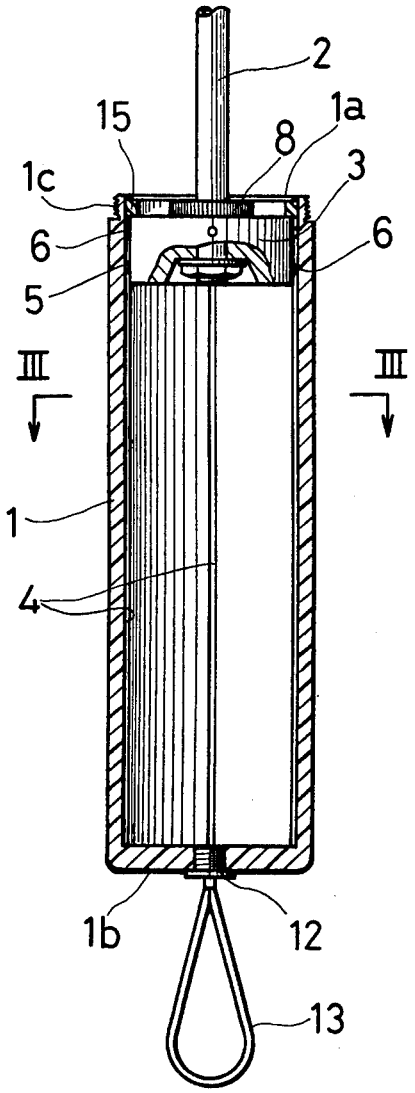
FIG. 2 is another partially sectional elevation of the embodiment in FIG. 1, a part cut away, when the sliding member is retained near the top end of sheathing handle.

Referring to FIGS. 1 and 2, the tubular sheathing handle 1 has an open top end 1a which is provided with a threaded outer wall 1c to mate with the threaded inner wall 9c of cap member 9, and also has a closed bottom end 1b provided with a plug 12 to be in connection with a handling strap 13. The plug 12 is screwed into the bottom end 1b of sheathing handle 1 water-tightly in cooperation with suitable packing members (not shown).

Figure 3:
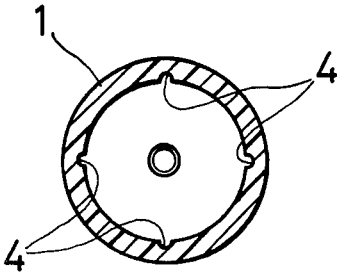
FIG. 3 is a cross section taken approximately on the line III—III in FIG. 2.

As best illustrated in FIGS. 2 and 3, tubular sheathing handle 1 has a cylindrical inner side wall which is provided with a plurality of axial grooves 4 extending from the bottom end 1b to the top end 1a to guide the tongue members 6 of sliding member 3 in slidably engaging relations thereto respectively. It is also provided with a plurality of spiral grooves 5 offsetting ascendingly from the axial grooves 4 near the top end 1a of sheathing handle 1 to guide the tongue members 6 in slidably engaging relations thereto respectively. Thus the sliding member 3 is engaged with the sheathing handle 1 in a slidable relation thereto.

The diameter of sliding member 3 is substantially equal to the inner diameter of tubular sheathing handle 1, and the inserted and sliding member 3 is slidably movable within the sheathing handle 1. The diameter of sliding member 3 is approximately two to three times the length thereof.

A water-tight annular packing member 15 of resilient material is provided inside the open top end 1a of sheathing handle 1.

The outer diameter of cap member 9 is equal to that of the tubular sheathing handle 1. The relative arrangement of cap member 9 in cooperation with the annular packing member 15, and sheathing handle 1 is such that the cap member 9 may close the open top end 1a of sheathing handle 1 water-tightly with the threads 1c and 9c being screwed with each other; in this state, the sheathing handle 1 and cap member 9 form a completely closed, water-tight hollow cylindrical casing.

The inner diameter of sheathing handle 1 is slightly larger than the overall diameter of the umbrella stick 2, frame 2' and canopy 7 altogether in a fully collapsed condition. The length of sheathing handle 1 is nearly equal to the overall length of the umbrella stick 2, frame 2' and canopy 7 altogether in a fully collapsed condition.

Figure 4:
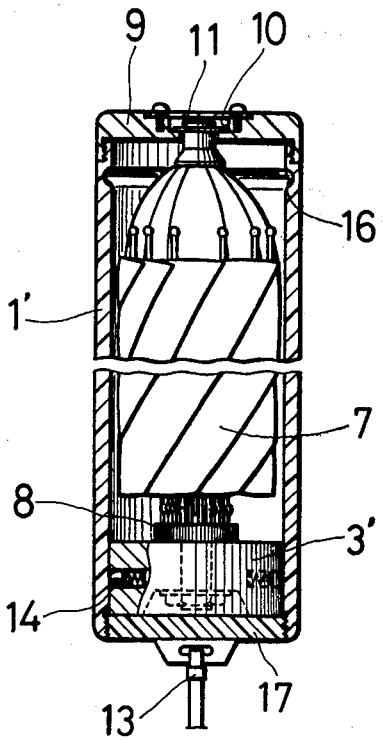
FIG. 4 is a partially sectional elevation of another embodiment, a part cut away.

As shown in FIGS. 1 and 4 stopper 8 is provided around the central stick 1 above the sliding member 3 to bind the umbrella frame 2', when necessary, in a known manner.

When the sliding member 3 is abutted on the lower end 2b of stick 2 within the tubular sheathing handle 1, the umbrella stick 2, frame 2' and canopy 7 altogether in a fully collapsed condition are withdrawn in the sheathing handle 1. Then the cap member 9 is screwed by hand to close the open top end 1a of sheathing handle 1 water-tightly in cooperation with the annular packing member 15.

In this state, the sheathing handle 1 and cap member 9 form a completely water-tight hollow cylindrical casing just large enough for the collapsed umbrella stick 2, frame 2' and canopy 7 together with the sliding member 3, as shown in FIG. 1. Thus the sheathing handle 1 attached to the stick 2 serves as a storing sheath for the umbrella when it is not on use.

When the cap member 9 is unscrewed from the top end 1a of sheathing handle 1 and pulled upward by hand, the collapsed stick 2, frame 2' and canopy 7 together with the sliding member 3 are drawn upward until the sliding member 3 is abutted against the lower end of annular packing member 15, with the tongue members 6 being guided along the axial grooves 4 in slidably engaging relations thereto respectively.

Then the sliding member 3 is turned spirally by handling the collapsed umbrella stick 2, frame 2' and canopy 7 altogether which are now almost completely out of the sheathing handle 1, in order to guide the tongue members 6 from the axial grooves 4 to the spiral grooves 5 respectively.

As the sliding member 3 is further turned spirally, it is raised spirally within the sheathing handle 1, with the tongue members 6 being guided along the spiral grooves 5 in slidably engaging relations thereto respectively, until it cannot be raised any more against the resilience of packing member 15. Thus the sliding member 3 is retained firmly below the packing member 15 near the open top end 1a of sheathing handle 1.

Figure 5:
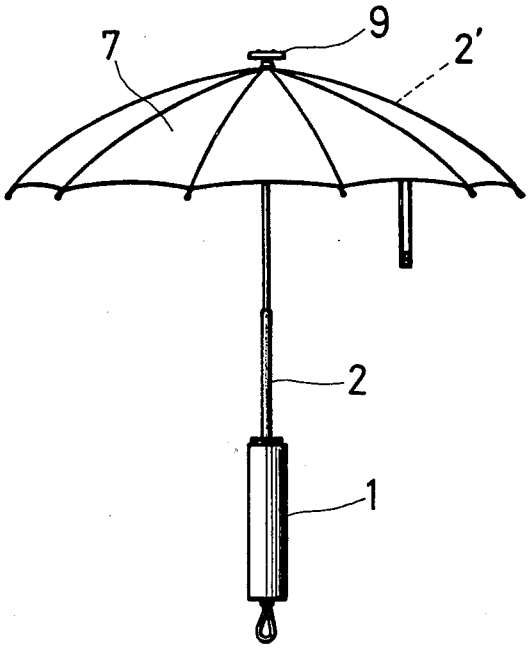
FIG. 5 is a front view of the embodiment of FIGS. 1, 2 and 3, when the umbrella stick, frame and canopy are in a fully stretched condition ready to use.

In this state, the umbrella stick 2, frame 2' and canopy 7 altogether in a fully collapsed condition are completely out of the sheathing handle 1 except that part of stick 2 below the stopper 8, as shown in FIG. 2. Then they are stretched or opened in a known way, and the umbrella is ready for use as shown in FIG. 5. Thus the sheathing handle 1 attached to the stick 2 serves as a handle for the umbrella when it is in use.

The umbrella stick 2, frame 2' and canopy 7 in a fully stretched condition as shown in FIG. 5 can be collapsed and returned into the sheathing handle 1 by following the reverse sequence.

The completely closed hollow cylindrical casing, formed by the sheathing handle 1 with the cap member 9 closing the top end 1a, is completely water-tight because all the apertures therein are closed water-tightly with screws andsuitable packing members. Thus the collapsed umbrella stick 2, frame 2' and canopy 7 can be stored in this casing in a completely water-tight manner, thereby eliminating the possibility of causing moisture trouble while they are stored in it.

The tubular sheathing handle 1 is almost as large as the umbrella stick 2, frame 2' and canopy 7 altogether in a fully collapsed condition. The tubular configuration of this size will be quite handy when it serves either as a storing sheath or as a handle for the umbrella.

As already mentioned, the sliding member 3 can be retained firmly near the top end 1a of sheathing handle 1, and the diameter of sliding member 3 is approximately two to three times the length thereof. These features make it possible for the umbrella stick 2, frame 2' and canopy 7 altogether to stand firmly in a fully stretched condition on use.

Moreover, the umbrella stick 2, frame 2' and canopy 7 altogether can be detached easily from the sheathing handle 1, after the annular packing member 15 is removed from the sheathing handle 1. This will facilitate assembling and disassembling of the umbrella.

In addition, the plug 12 can be detached easily from the sheathing handle 1 merely by unscrewing, and this will facilitate draining moisture and drying the inside of sheathing handle 1.

The embodiment shown in FIG. 4 has a rigid tubular sheathing handle 1' which is provided with a cylindrical inner side wall having a circumferential groove 16 near the open top end thereof. It also has a bottom member 17 which is screwed to the lower end of sheathing handle 1' to close it water-tightly in cooperation with suitable packing members (not shown).

This embodiment further has a cylindrical sliding member 3' which is provided with a plurality of radial recesses in the outer periphery thereof and a plurality of spring-loaded tongue members 14 fitted therein respectively.

The tongue members 14 are always completely within the radial recesses against the elasticity of their springs respectively, except when they meet the circumferential groove 16.

The sliding member 3' is slidably movable within the tubular sheathing handle 1' in an inserted relation thereto. When the sliding member 3' is raised up to the level where the spring-loaded tongue members 14 meet the circumferential groove 16, they extend radially into engagement with the circumferential groove 16 by the elasticity of their springs. And thus the sliding member 3' is retained near the open top end of sheathing handle 1'.

The circumferential groove 16 is tapered downwardly towards the lower end of the sheathing handle so that the tongue members 14 may be permitted to get into, and get out of, the groove 16 to and from the lower part of the sheathing handle 1' but that they may not be permitted to proceed upwardly beyond groove 16.

In all other aspects, the embodiment shown in FIG. 4 is constructed similarly to the preceeding embodiment. The like numbers indicate the like members.

In the embodiment shown in FIG. 4, the umbrella stick ,frame and canopy altogether can be easily detached downward from the sheathing handle 1', merely after the cap member 9 is removed from the stick and the bottom member 17 is removed from the sheathing handle 1', so as to facilitate assembling and disassembling. The cap member 9 can be detached from the stick easily by removing the cover member 10 and the snap ring 11 from it. The bottom member 17 can be easily removed from the sheathing handle 1' merely by unscrewing, and this will also facilitate draining moisture and drying the inside of sheathing handle 1'.

It will be understood that further modifications may be made in the constructions of the above-given embodiments, and that the invention is in no way limited thereto.

What is claimed is:

1. A collapsible umbrella having a central telescopic stick, a radiating folding frame partially slidable on said stick, a circular fabric canopy fastened to said frame, and a rigid tubular sheathing handle attached to said stick in an aligned relation thereto, said central telescopic stick having an upper end provided with a round cap member in a rotatably engaging relation thereto and a lower end provided with a cylindrical sliding member in a securely fixed relation thereto, said rigid tubular sheathing handle having an open top end, a closed bottom end and a cylindrical inner side wall, said sliding member having a plurality of tongue members in radiating relation thereto being slidably movable within said sheathing handle in an inserted relation thereto, the inner side wall of said sheathing handle being provided with axial grooves to guide said sliding member axially between the bottom end and top end of said sheathing handle in slidably engaging relation with the tongue members and spiral grooves offsetting ascendingly from said axial grooves near the top end of the sheathing handle to retain said sliding member at said near top end of said sheathing handle so that said stick, frame and canopy altogether in a fully collapsed condition may be withdrawn in said sheathing handle when said sliding member is at the bottom end of said sheathing handle, that said sheathing handle may form a completely closed and water-tight hollow cylindrical casing just large enough to enclose said stick, frame and canopy altogether in a fully collapsed condition when the top end of said sheathing handle is closed with said cap member, and that said stick, frame and canopy altogether in a fully collapsed condition may be almost completely out of said sheathing handle when said sliding member is retained near the top end of said sheathing handle, whereby said tubular sheathing handle serves a dual purpose as a storing sheath and as a handle for the umbrella.

2. A collapsible umbrella having a central telescopic stick, a radiating folding frame partially slidable on said stick, a circular fabric canopy fastened to said frame, and a rigid tubular sheathing handle attached to said stick in an aligned relation thereto, said central telescopic stick having an upper end provided with a round cap member, said cap member having an aperture and a snap ring in which the upper end of said stick is retained, in a rotatably engaging relation thereto, and a lower end provided with a cylindrical sliding member in a securely fixed relation thereto, said rigid tubular sheathing handle having an open top end, a closed bottom end and a cylindrical inner side wall, said sliding member having a plurality of tongue members in radiating relation thereto being slidably movable within said sheathing handle in an inserted relation thereto, the inner side wall of said sheathing handle being provided with means to retain said sliding member near the top end of said sheathing handle so that said stick, frame and canopy altogether in a fully collapsed condition may be withdrawn in said sheathing handle when said sliding member is at the bottom end of said sheathing handle, that said sheathing handle may form a completely closed and water-tight hollow cylindrical casing just large enough to enclose said stick, frame and canopy altogether in a fully collapsed condition when the top end of said sheathing handle is closed with said cap member, and that said stick, frame and canopy altogether in a fully collapsed condition may be almost completely out of said sheathing handle when said sliding member is retained near the top end of said sheathing handle, whereby said tubular sheathing handle serves a dual purpose as a storing sheath and as a handle for the umbrella.

* * * * *